United States Patent [19]

Wylie et al.

[11] Patent Number: 4,740,874

[45] Date of Patent: Apr. 26, 1988

[54] WYLIE-LITE

[76] Inventors: Bruce E. Wylie, 4091 Irvin Cir. No., Lake Elmo, Minn. 55042; James J. Vaessen, 200 S. Winthrop St., St. Paul, Minn. 55119

[21] Appl. No.: 804,630

[22] Filed: Dec. 5, 1985

[51] Int. Cl.[4] ..... F21L 7/00

[52] U.S. Cl. ..... 362/268; 362/187; 362/347; 362/396; 362/190

[58] Field of Search ..... 362/158, 190, 197, 204, 362/341, 328, 347, 329, 396

[56] References Cited

U.S. PATENT DOCUMENTS

| | | | |
|---|---|---|---|
| 2,298,042 | 10/1942 | Desimone | 302/207 |
| 2,493,205 | 1/1950 | Muldoon | 362/207 |
| 2,530,913 | 11/1950 | Shackel | 362/207 |
| 2,591,269 | 4/1952 | Lehoczki | 362/208 |
| 2,611,019 | 9/1952 | Warner | 362/208 |
| 2,680,844 | 6/1954 | Smith | 362/208 |
| 2,823,300 | 2/1958 | Graubner | 362/208 |
| 3,265,880 | 8/1966 | Whitman | 362/207 |
| 3,323,117 | 5/1967 | Mason | 362/158 |
| 3,323,118 | 5/1967 | Chan | 362/197 |
| 3,539,797 | 11/1970 | Brindley et al. | 362/158 |
| 4,274,130 | 6/1981 | Elliott | 362/184 |
| 4,325,107 | 4/1982 | MacLeod | 362/207 |
| 4,357,648 | 11/1982 | Nelson | 362/207 |
| 4,458,299 | 7/1984 | Stephens et al. | 362/158 |
| 4,530,039 | 7/1985 | Shin-Shi | 362/268 |
| 4,533,982 | 8/1985 | Kozar | 362/190 |

*Primary Examiner*—E. Rollins Cross

[57] ABSTRACT

A safety flashlight (30) according to the invention includes a heavy duty magnet (1) secured to a cap (3) in turn connected to a main housing (9). A preferred flashlight (30) also includes a reflector cone (16) arranged to intercept a concentrated beam produced by a light bulb assembly (13) and radially reflect the light to make it noticeable irrespective of the angular orientation of the viewer with respect to the light (30). An electronic flashing circuit (10) is secured within the housing (9) using a synthetic rubber compound which insulates the circuit (10) and makes it less sensitive to shock.

2 Claims, 1 Drawing Sheet

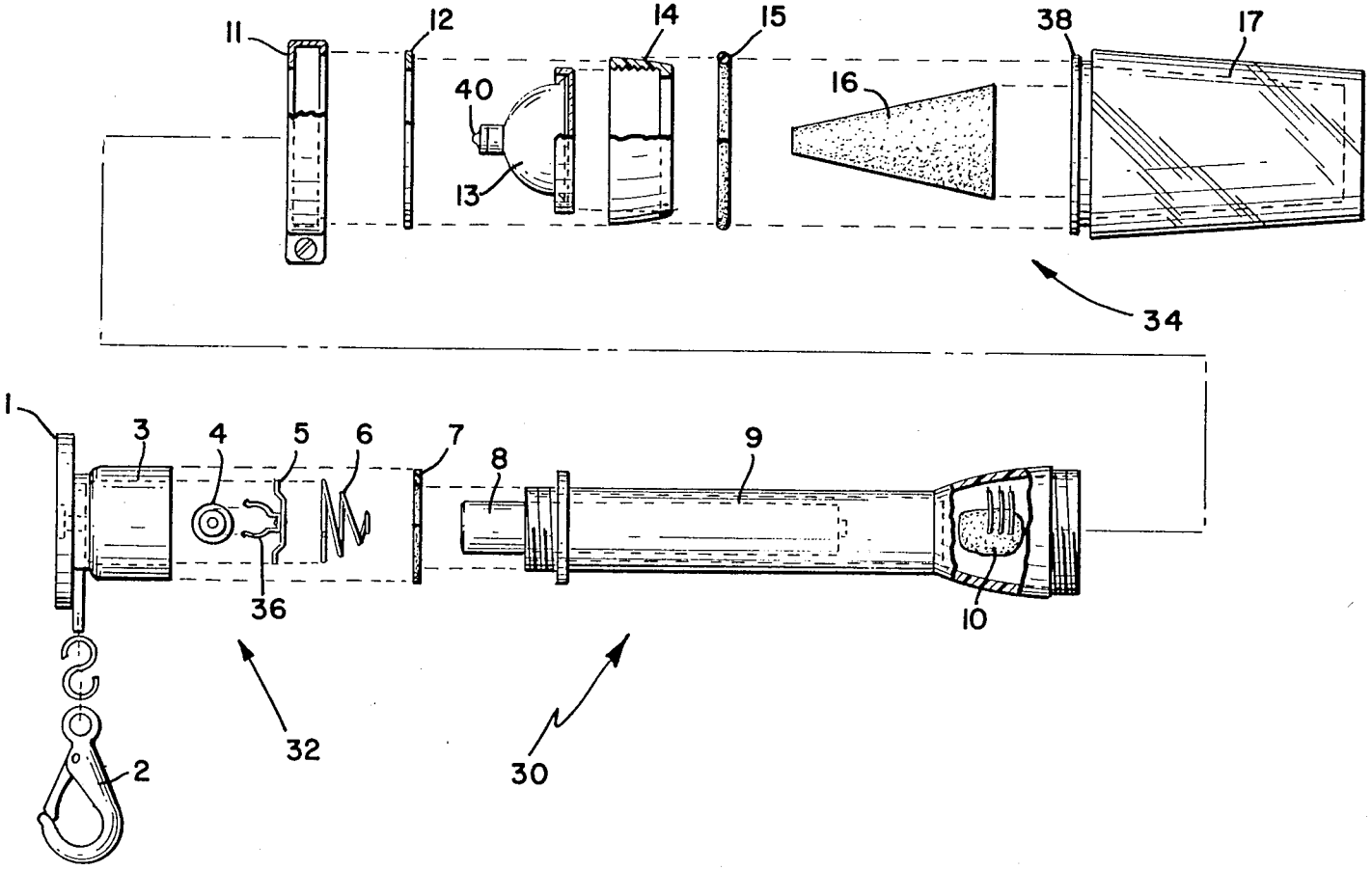
17
38
34
16
15
14
40
13
12
11
10
9
30
8
7
6
5
36
32
4
3
2
1

WYLIE-LITE

FIELD OF THE INVENTION

The invention relates to flashing lights for signifying possible hazardous situations.

BACKGROUND OF THE INVENTION

The Code of Federal Regulations, Title 49, Section 218 prescribes minimum requirements for railroad operating rules and practices. Among other things, Section 218 sets out minimum requirements for the protection of railroad employees engaged in the inspection, testing, repair and servicing of rolling equipment whose activities require them to work on, under or between such equipment subjecting them to the danger of personal injury posed by any movement of such equipment. One such requirement is that "blue signals" be displayed by workmen who are working on or around rolling equipment, wherein a "blue signal" is a clearly distinguishable blue flag or blue light by day or a blue light by night. A blue signal thus signifies that workmen are on, under, or between rolling equipment on the track, and that other rolling equipment may not enter the track except under specific conditions. The present invention is a hazard light which can be used as a "blue signal," either for railroad or maritime applications, although the hazard light of the present invention can be used in other contexts and for other purposes. For the sake of brevity, the remaining discussion will focus on use of the hazard light of the present invention as a "blue signal" for railroad workmen.

The prior art includes several "blue signals" pursuant to Section 218. As discussed above, blue flags can be used, but only during daylight hours. Moreover, flags are not particularly noticeable, even during the day. Blue lights have also been employed, but the typical blue railroad hazard light includes one or more heavy lantern batteries. Also, the typical lantern-style hazard light is simply set on the track and is incapable of being conveniently secured to rolling equipment. This necessitates relocating the light(s) every time the rolling equipment is even slightly moved. Further, the typical hazard light provides a fairly narrow or concentrated light beam which is noticeable only by someone who is aligned with the concentrated beam. Still another problem with prior art hazard lights is their lack of durability and sensitivity to shock and orientation.

The present invention addresses the problems associated with prior art railroad hazard lights. In particular, a preferred embodiment of the invention is a blue signal light which is portable, readily attachable to rolling equipment, durable, energy-efficient, orientation-insensitive and which reflects, scatters or disperses a concentrated beam to make the light more readily noticeable irrespective of viewing angle.

SUMMARY OF THE INVENTION

Accordingly, in broad terms the present invention includes:

(a) a battery housing suitable for holding a battery, the housing having an axis, a cap end and a lens end;

(b) a heavy duty magnet secured to the housing;

(c) a light bulb assembly secured to the lens end of the housing suitable for operatively connecting to the battery and for producing concentrated light substantially parallel to the axis of the battery housing; and (d) a lens assembly secured to the lens end of the housing comprising means axially aligned with the light bulb assembly for radially reflecting the concentrated light produced by the light bulb assembly, whereby the hazard light can be secured to a ferrous object and can supply a radially dispersed warning light capable of observation irrespective of the angular orientation of the viewer with respect to the hazard light.

Preferably, though not necessarily, hazard lights constructed according to the invention include the following features:

(a) a heavy duty magnet secured to the cap end of the housing;

(b) an electronic solid state flashing circuit suitable for connection to the battery;

(c) a flashing circuit encased within a synthetic rubber compound and secured thereby to the battery housing, wherein the synthetic rubber compound acts as an electrical insulator for the flashing circuit and makes the hazard light durable and relatively insensitive to shock;

(d) a reflecting means including a cone having an apex and a base, wherein the apex is located proximate the light bulb assembly, and wherein the outer surface of the cone radially reflects the concentrated light produced by the light bulb assembly;

(e) a reflecting cone made from styrofoam;

(f) a cap secured to the cap end of the housing, a negative compression spring bearing operatively disposed within the cap having a back surface and a front surface and comprising a clip extending from the back surface suitable for holding an extra light bulb, and a substantially conical spring having its base in operative contact with the negative compression spring bearing, wherein the spring bearing eliminates skewing of the compression spring so that the spring will in turn maintain continuous contact with the battery; and (g) a lens clamp having a channel configuration for wedging the lens assembly into sealing contact with the lens end of the housing.

The preferred embodiment of the invention will be further described with reference to the drawing.

BRIEF DESCRIPTION OF THE DRAWING

The drawing shows an exploded view of a preferred hazard light according to the invention.

DETAILED DESCCRIPTION OF THE PREFERRED EMBODIMENT

The drawing shows a preferred hazard light 30 constructed according to the invention. The light 30 includes a battery housing 9 capped at one end with a cap assembly 32 and at the other end with a lens assembly 34.

Cap assembly 32 preferably includes a hollow battery cap 3 suitable for attachment at its open end to the battery housing 9. A weather seal 7 sealingly engages cap 3 and housing 9. Secured to the closed end of cap 3 is a heavy duty magnet 1 which can be used to attach the light 30 to any ferrous object, e.g., a railroad car or the steel rail of a railroad truck. Also attached to cap 3 is a snap hook 2 which can be used to connect light 30 to a wide variety of objects regardless of their magnetic properties.

Resting within battery cap 3 is a negative compression spring bearing 5. On the back side of bearing 5 is a clip 36 suitable for holding an extra light bulb 4 within cap 3. The front side of bearing 5 supports the large end of a cone-shaped compression spring 6, the small end of which is suitable for bearing against the negative casing of a battery 8 (hence the term "negative" bearing). The bearing 5 maintains continuous contact with and eliminates skewing of compression spring 6 so that spring 6 will in turn maintain continuous contact with the negative casing of battery 8.

Turning to the lens end of light 30, lens assembly 34 preferably includes a light bulb housing and crystal 13 suitable for holding a light bulb in operative contact with the positive terminal of battery 8. The positive terminal of the light bulb within housing 13 is designated with the reference numeral 40 in the drawing, although the remainder of the light bulb is not shown. A light bulb housing retainer 14 engages housing and crystal 13 and attaches to the main housing 9 such that the light bulb positive terminal 40 can come into electrical contact with the positive end of battery 8. Held between the light bulb housing retainer 14 and the housing 9 is a ring-like lens seal bearing 12 which has an outside diameter greater than the outside diameter of housing 9.

Another component of lens assembly 34 is a hollow blue lens 17 in the shape of a truncated cone. The base of lens 17 forms a lip 38, the function of which is described below. Secured within lens 17 is a stryofoam cone 16, the apex of which is held tight against crystal 13 when the components are assembled. The cone 16 functions to reflect, scatter, or disperse concentrated light produced by the light bulb within the housing and crystal 13. Of course, reflector 16 could be any shape or size, and is not limited to the configuration shown and described herein.

Lens assembly 34 also includes a housing/lens clamp 11 which connects lens 17 to the other components of light 30. Clamp 11 includes a ring-like structure which is in the nature of a channel which can engage lip 38 and lens seal bearing 12 and wedge them together. A lens seal 15 is interposed between lens 17 and lens bearing 12.

The foregoing is a description of the basic components of light 30 and their mechanical interrelationship. A detailed description of the electrical circuit of light 30 is unnecessary in view of the fact that the electrical principles behind flash light construction are well known, but brief mention of several salient aspects of the circuit is in order. The negative end of battery 8 is proximate cap 3 and the positive end of battery 8 is proximate lens assembly 34. A switch (not shown) can selectively complete a circuit which includes the bulb within housing 13 and a flashing circuit 10, preferably a solid state electronic flashing circuit of standard design. The uniqueness of circuit 10 lies in the way it is secured to the inner surface of housing 9: Circuit 10 is dipped into a liquid synthetic rubber compound and applied thereto. The synthetic material is heated, causing it to solidify and molecularly secure circuit 10 to housing 9. The synthetic rubber compound encases circuit 10 and serves as an insulator for the solid state electronic circuit.

OPERATION

In operation, light 30 is preferably attached to a ferrous object, i.e., a railroad car or the track rail. Alternatively, snap hook 2 can be used to secure the light 30 to any convenient structure. Once the light 30 is secured, it can be activated. Battery 8 supplies electrical power to the bulb within bulb housing 30 and the electronic flashing circuit 10 secured on the inner side of housing 9. The bulb within housing 13 thereby creates a flashing concentrated beam of light. Reflector cone 16 causes this concentrated beam of light to scatter or disperse radially outward from the light 30 through blue lens 17. Thus, a flashing blue light which is visible at any radial position relative to light 30 is generated.

Preferred embodiments of the invention have been disclosed. Other modifications of the invention which are not specifically disclosed or referred to will be apparent to those skilled in the art in light of the foregoing description. Put simply, this description is intended to provide concrete examples of preferred embodiment structures and applications, clearly disclosing the present invention and its operative principles. Accordingly, the invention is not limited to any particular embodiments or configurations and variations of the present invention which fall within the spirit and broad scope of the appended claims are covered.

We claim:

1. A hazard light comprising:

(a) a battery housing suitable for holding a battery, the housing having an axis, a cap end and a lens end;

(b) a light bulb assembly comprising a light bulb secured to the lens end of the housing suitable for operatively connecting to the battery and for producing concentrated light substantially parallel to the axis of the battery housing;

(c) a cap secured to the cap end of the housing, a negative compression spring bearing operatively disposed within the cap having a back surface and a front surface and comprising a clip extending from the back surface suitable for holding an extra light bulb, and a substantially conical spring having its base in operative contact with the negative compression spring bearing, wherein the spring bearing eliminates skewing of the compression spring so that the spring will in turn maintain continuous contact with the battery;

(d) a heavy duty magnet secured to the cap, whereby the hazard light can be secured to a ferrous object;

(e) a blue lens secured to the lens end of the housing;

(f) a lens clamp having a channel configuration for wedging the lens assembly into sealing contact with the lens end of the housing; and (g) a stryofoam reflector cone secured within the blue lens having an apex and a base, wherein the apex is located proximate the light bulb assembly, and wherein the outer surface of the cone radially reflects the concentrated light produced by the light bulb assembly through the blue lens, whereby the hazard light can supply a radially dispersed blue warning light capable of observation irrespective of the angular orientation of the viewer with respect to the hazard light.

2. A hazard light comprising:

(a) a battery housing suitable for holding a battery, the housing having an axis, a cap end and a lens end;

(b) a light bulb assembly comprising a light bulb secured to the lens end of the housing suitable for operatively connecting to the battery and for producing concentrated light substantially parallel to the axis of the battery housing;

(c) a cap secured to the cap end of the housing;

(d) a heavy duty magnet secured to the cap, whereby the hazard light can be secured to a ferrous object;

(e) a blue lens secured to the lens of the housing;

(f) a means for securing the lens assembly to the lens end of the housing;

(g) a stryofoam reflector cone secured within the blue lens having an apex and a base, wherein the apex is located proximate the light bulb assembly, and wherein the outer surface of the cone radally reflects the concentrated light produced by the light bulb assembly through the blue lens, and whereby the hazard light can supply a radially dispersed blue warning light capable of observation irrespective of the angular orientation of the viewer with respect to the hazard light; and (h) an electronic solid state flashing circuit electrically connected to the light bulb and capable of electrically contacting the batteries in the battery housing for flashing the light bulb at predetermined intervals.

* * * * *